United States Patent [19]

Shimaohgi et al.

[11] Patent Number: 4,900,978

[45] Date of Patent: Feb. 13, 1990

[54] ELECTRON GUN HAVING BLACKENED GRIDS USED IN-LINE TYPE COLOR CRT, AND COLOR CRT USING THE SAME

[75] Inventors: Toshio Shimaohgi; Hideo Mori; Tadanori Okada, all of Fukaya, Japan

[73] Assignee: Kabushiki Kaisha Toshiba, Kawasaki, Japan

[21] Appl. No.: 171,734

[22] Filed: Mar. 21, 1988

[30] Foreign Application Priority Data

Mar. 23, 1987 [JP] Japan ..... 62-65554

[51] Int. Cl.[4] ..... H01J 29/56

[52] U.S. Cl. ..... 313/409; 313/428; 313/449; 313/458

[58] Field of Search ..... 313/409, 412, 414, 428, 313/449, 450, 458, 460

[56] References Cited

U.S. PATENT DOCUMENTS 4,546,287 10/1985 Collins et al. ..... 313/409 X

FOREIGN PATENT DOCUMENTS 59-141140 8/1984 Japan .
59-211933 11/1984 Japan .
60-35163 10/1985 Japan .
61-290635 12/1986 Japan .
62-229642 10/1987 Japan .

*Primary Examiner*—Kenneth Wieder
*Attorney, Agent, or Firm*—Cushman, Darby & Cushman

[57] ABSTRACT

An in-line type color CRT electron gun having a triode and a plurality of grids, characterized in that at least one of the plurality of grids is made of a black member or a member on which a black film is formed. The time required for attaining a stable temperature of the member is reduced, thereby improving deviations in static convergence and reducing the time required for an image to be normally displayed.

8 Claims, 4 Drawing Sheets

ELECTRON GUN HAVING BLACKENED GRIDS USED IN-LINE TYPE COLOR CRT, AND COLOR CRT USING THE SAME

BACKGROUND OF THE INVENTION

I. Field of the Invention

The present invention relates to an electron gun used in an in-line type color CRT for displaying an image by converging a plurality of electron beams on a phosphor screen and to a color CRT using the same.

II. Description of the Related Art

An in-line type color CRT has usually three electron guns and is designed to display an image by converging three electron beams emitted from these electron guns onto a phosphor screen. FIG. 1 is a schematic sectional view of an in-line type color CRT. Phosphor screen 22 composed of three color phosphors is arranged on an inner surface of panel 21, which constitutes a front surface portion of envelope 20. Shadow mask 23 is arranged in envelope 20 at a predetermined distance from phosphor screen 22. Electron gun 26 is arranged in a neck 24 constituting a rear end portion of envelope 20. Three electron beams 25B, 25G, and 25R emitted from electron gun 26 pass through shadow mask 23 and are incident on phosphor screen 22, thereby displaying a color image.

Electron gun 26 comprises three cathodes **28*a*, 28*b*, and 28*c*, heaters (not shown) for independently heating these cathodes, and first to sixth grids 31 to 36 arranged in this order from the cathodes toward phosphor screen 22** along the axis of the CRT. Each grid is formed into a flat plane or a cylindrical shape having three holes allowing the electron beams to pass through them.

If the three electron beams are not properly converged on the phosphor screen, an incomplete display of an image is caused.

Convergence of the electron beams in a central area of the screen (static convergence) is adjusted by causing three unit electron guns to be inclined with each other, or tilting a main lens with respect to a passing direction of an electron beam. Convergence of the electron beams in a peripheral area of the screen (dynamic convergence) is adjusted by utilizing a convergence correcting unit, or self-convergence using nonuniform magnetic fields in a deflection yoke unit.

In the color CRT, a stable electron beam current can only be obtained by suppressing the so-called flying phenomenon, in which an electron beam current is greatly changed right after the heaters are lighted as compared with a stabilized current value. Especially in a type such as a display tube which displays a negative image such as a character or a figure on a non-emissive dark portion, degradation of the image contrast is caused by the flying phenomenon. In the color CRT, incomplete fidelity of color is also caused.

Japanese Utility Model Publication No. 60-35163 discloses a picture tube, wherein a first grid of an electron gun is composed of a member having a low thermal expansion coefficient (about $12.0\times10^{-6}$) so as to decrease an amount of flying of an electron beam current and quickly stabilize the current. However, if the first grid is composed of a member having a low thermal expansion coefficient, static convergence is degraded. The reason will be described by exemplifying a unibipotential type electron guns generally used in a color CRT. As shown in FIG. 1, this electron gun comprises three cathodes **28*a*, 28*b*, and 28*c*, heaters (not shown) for independently heating these cathodes, and first to sixth grids 31 to 36** arranged in this order from the cathodes toward a phosphor screen. The cathodes, and the first and second grids constitute a triode. Voltages shown in Table 1 are normally applied to each cathode, each grid, and each heater. An electron beam emitted from each cathode which has received a video signal is cut off by the cathode voltage shown in Table 1.

TABLE 1

| | |
|---|---|
| Cathode | 100 to 150 V |
| First grid | 0 V |
| Second grid | 300 to 1,000 V |
| Third grid | 16 to 35% of voltage applied to six grid |
| Fourth grid | Equal to voltage applied to second grid |
| Fifth grid | Equal to voltage applied to third grid |
| Sixth grid | 10 to 30 kV |
| Heater | 3 to 6.3 V |

The first and second grids are control grids for accurately emitting electron beams in accordance with the video signal. The electron beams forms a crossover point once near the first or second grids, and then diverged into the third grid while being diverged. Then, the electron beams are focused by a main electron lens system constituted by the third to sixth grids, and formed images on the phosphor screen.

Accurate image formation can be realized only after the cathodes and respective grids have been heated by the heaters to the point where they are thermally stabilized.

Stable (maximum) temperatures for the cathodes and the respective grids are shown in Table 2. The periods of time required for raising the temperatures up to the respective stable temperatures are: about 5 seconds for the cathodes, about 10 minutes for the first and second grids, and about 15 to 20 minutes for the third to six grids.

TABLE 2

| | |
|---|---|
| Cathode | 700 to 900° C. |
| First grid | 150 to 300° C. |
| Second grid | 100 to 200° C. |
| Third grid | 80 to 120° C. |
| Fourth grid | 50 to 100° C. |
| Fifth and six grids | About 50° C. |

Each electrode is elongated in both an axial direction of the tube and a direction perpendicular to the tube axis until a corresponding stable temperature is attained.

The elongation along the tube axis causes the deviation of intervals between respective grids from the predetermined values, resulting in the flying phenomenon. Especially the change of interval between each cathode and the first grid has much influence upon the flying phenomenon. On the other hand, the elongation perpendicular to the tube axis causes the difference of three unit gun's separation among the respective grids, resulting in the degradation of static convergence. For this reason, the static convergence and cutoff are set after the electron gun is sufficiently heated.

If each grid is composed of a stainless member having an thermal expansion coefficient of about $17.0\times10^{-6}$ at 0° to 300° C., the cathodes, and the first and second grids are elongated in the axial direction of the tube, as shown in FIG. 2.

The amount of flying of the electron gun is greatly influenced by the elongation of the first grid. The reason is as follows.

Cutoff voltage $E_C$ can be given by the following formula. The electron beam current is increased in proportion to the value of cutoff voltage $E_C$.

$$E_C \propto \phi^3 . E_{C2}/a.f.t$$

where $\phi$: a diameter of a hole of the first grid a: a distance from the first grid to the cathodes f: a distance from the first grid to the second grid t: a thickness of the first grid $E_{C2}$: a voltage applied to the second grid In the above formula, $\phi$, t, and $E_{C2}$ can be regarded as being always constant, whereas a and f are changed from the start time of the heaters. Assume that a and f upon lighting of the heaters and after they are sufficiently heated are respectively set as $a_1$ and $f_1$, and $a_2$ and $f_2$. If the product of a and f is constant, i.e., $a_1.f_1=a_2.f_2$, a substantially ideal flying characteristic can be obtained, as indicated by curve 5 in FIG. 3. When $a_1.f_1>a_2.f_2$, a characteristic represented by curve 6 is obtained, and when $a_1.f_1<a_2.f_2$, a characteristic represented by curve 7 is obtained. Accordingly, if the first grid is composed of a member having a low thermal coefficient, changes in a and f can be reduced, and hence the characteristic of the electron beam represented by curve 6 or 7 can be made close to that represented by curve 5. Note that curve 8 represents the predetermined current value of the electron beam.

However, even if the first grid is composed of a member having a low thermal expansion coefficient so as to improve the flying characteristic, the static convergence cannot be improved, until respective grids have reached their stable temperature. This is because the centers of the holes of the respective grids are shifted from each other, until respective grids have reached their stable temperature, because of variations in elongation of the respective grids in the direction perpendicular to the axial direction of the tube due to differences between times required for attaining the respective stable temperatures of the third to sixth grids constituting the main electron lens system, as described above, thereby adversely affecting the convergence of the three electron beams.

FIG. 4 shows a measurement result of static convergence when each grid of the electron gun is formed by a generally used stainless member. The axis of abscissa represents an elapsed time from the start of the heaters. Curve 39 represents changes in static convergence with the lapse of time caused by misalignment of the centers of the holes between the first and second grids. Similarly, curves 40, 41, and 42 respectively represent changes in static convergence with the lapse of time caused by misalignment of the centers of the holes between the second and third grids, between the third and fourth grids, and between the fourth and fifth grids. Changes in static convergence as a whole with the lapse of time are represented by curve 43 obtained by adding curves 39 to 42 to each other. Accordingly, deviations of the centers are very large immediately after the heaters are lighted.

If the first and second grids are made of members each having a low thermal expansion coefficient of $12.0\times10^{-6}$ or less in order to obtain an optimal flying characteristic during the output of an image, an under-convergence component in the static convergence indicated by curve 39 in FIG. 4 is reduced. Namely, as is apparent from the changes in static convergence with the lapse of time indicated by curve **44*a* or 44*b* shown in FIG. 5, the static convergence immediately after the lighting of heaters is excellent, however, overconvergence is increased with the lapse of time, and the peak value is attained after three minutes. As a whole, the static convergence characteristic is worse than that in the case using the stainless member. Curve 44*a* represents changes in static convergence when the first and second grids are made of a 42% Ni-Fe alloy (NSD) having a thermal expansion coefficient of $5.0\times10^{-6}$ at 0° to 300° C., and the third grid et seq. are made of stainless steel having a thermal expansion coefficient of $17.0\times10^{-6}$. Curve 44*b* represents changes in static convergence when the first grid is made of a 50% Ni-Fe alloy (TNF) having a thermal expansion coefficient of $9.4\times10^{-6}$ to $10.4\times10^{-6}$ at 30° to 400° C., and the second and third grids et seq. are respectively made of NSD and stainless steel. Assume that the thermal expansion coefficients of the first, second and third grids et seq. are respectively set to be $\alpha_1$, $\alpha_2$, and $\alpha_3$. Then, in both curves 44*a* and 44*b***, $$\alpha_2 \leqq \alpha_1 < \alpha_3$$

As is apparent from the comparison between curves **44*a* and 44*b*, in order to further reduce changes in static convergence with the lapse of time, thermal expansion coefficient $\alpha_2$ of the second grid 2** may be further decreased. However, no member is found, which can satisfy characteristics required for grids, and has a thermal expansion coefficient smaller than NSD.

SUMMARY OF THE INVENTION

In order to solve the above-described problems, according to the present invention, there is provided an in-line type color CRT electron gun comprising a triode and a plurality of grids, characterized in that at least one of the plurality of grids is made of a black member or a member on which a black film is formed.

Furthermore, according to the present invention, there is provided an in-line type color CRT using electron gun comprising a triode and a plurality of grids, characterized in that at least one of the plurality of grids is made of a black member or a member on which a black film is formed.

DETAILED DESCRIPTION OF THE PREFERRED EMBODIMENT

Figure 1:
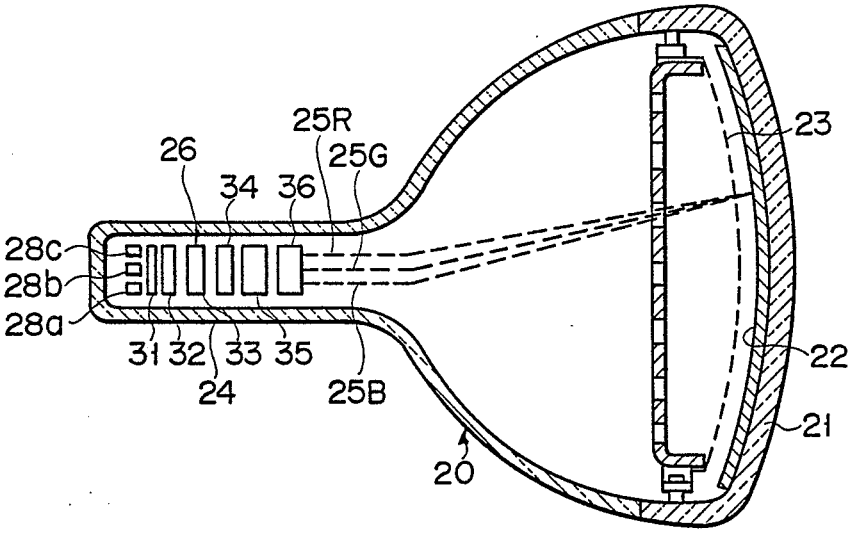
F I G. 1 (PRIOR ART)
FIG. 1 is a sectional view of a color CRT.
Figure 2:
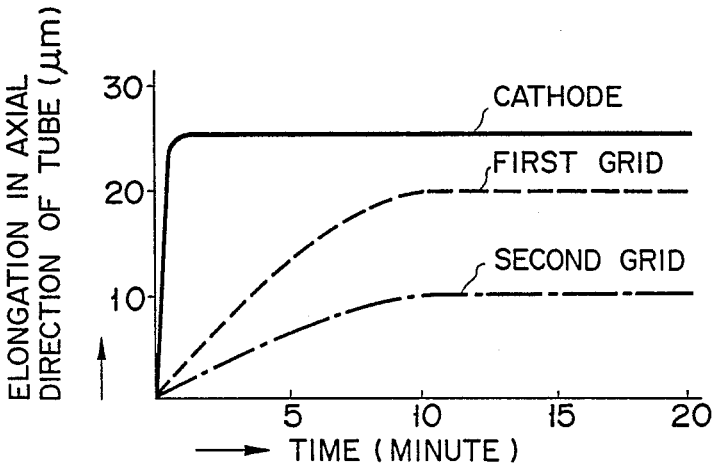
FIG. 2 is a graph showing elongation of cathodes and grids in an axial direction of the tube.
Figure 3:
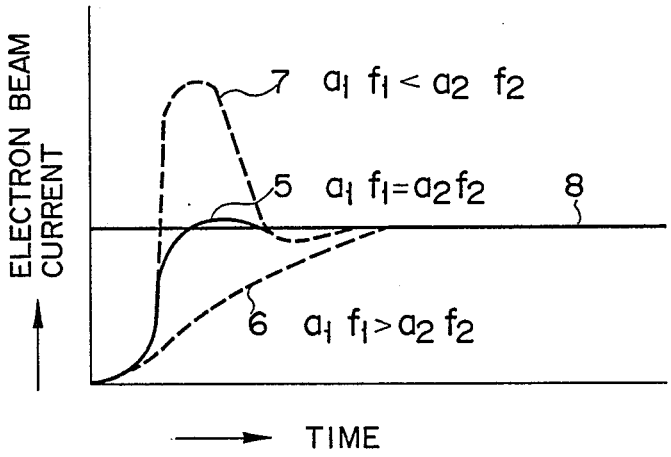
FIG. 3 is a graph showing a flying characteristic of an electron beam current.
Figure 4:
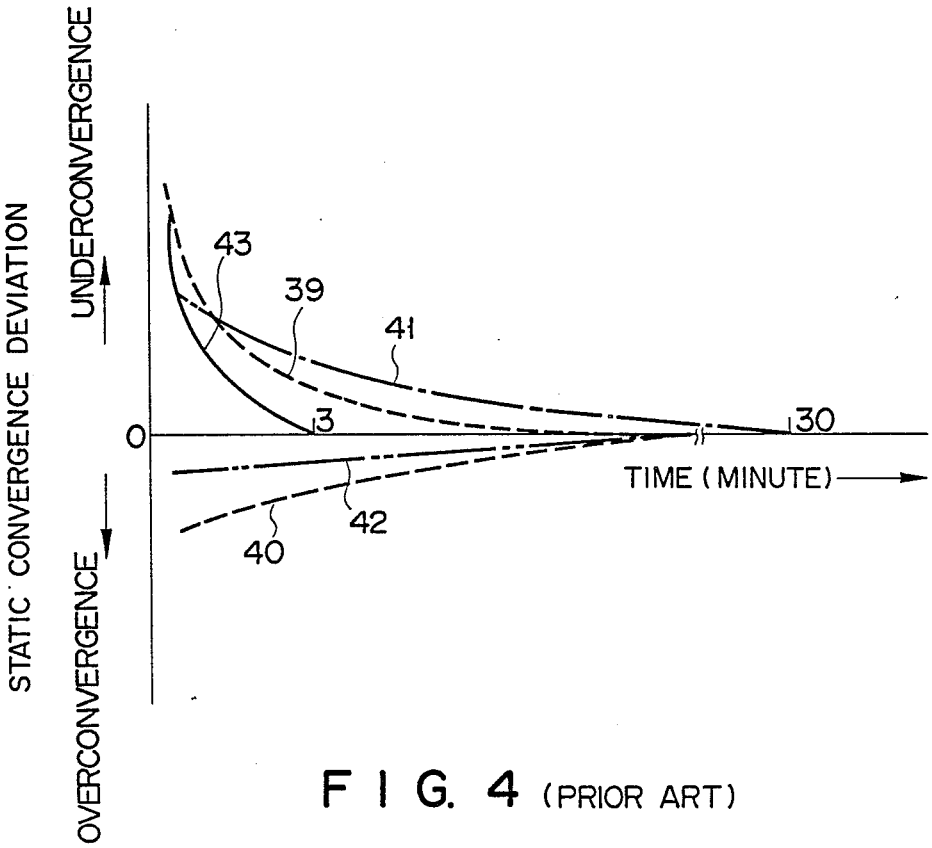
F I G. 4 (PRIOR ART)
FIG. 4 is a graph showing changes in static convergence as a function of time.

According to the present invention, at least one of grids constituting overconvergence shown in FIG. 4 is composed of a black member or a member having a black film on its surface so as to reduce the time required for attaining a stable temperature of the member, thereby improving deviations in static convergence and reducing the time required for an image to be normally displayed.

The reason for excluding the grids in a triode is as follows.

For the purpose of degassing, the first and the second grids are generally baked at about 850° C. right before glass-tipping-off procedure in exhausting process. If these grids are composed of black members, clusters of black materials such as oxides are often evaporated from them in this process and sometimes deposited on the cathodes, because those grids are neighbored to the cathodes. Such a cathode damage is not preferable to the beam emission.

In addition, the second grid with a black member is hardly effective to suppress the static convergence deviation. With reference to FIG. 4, though its third grid side will decrease the overconvergence (40) its first grid side will simultaneously decrease the underconvergence (39). As a result the suppressing effect will be cancelled.

EXAMPLE

In an electron gun in the Example, third and fifth grids 33 to 35 were respectively composed of pairs of stainless members 33*a* and 33*b*, 34*a* and 34*b*, and 35*a* and 35*b*. Note that first and second grids were made of TNF and NSD, respectively. A grid member was blackened in such a manner that hydrogen was passed through water of about 18° C., and the grid members were located in a furnace at 1,000° C. and oxidized by the resultant hydrogen for about 10 minutes. The obtained blackened film is mainly composed of $FeCr_2O_4$+-$(FeCr)_2O_3$. The thickness of this film is about 1 μ. Provided that the emissivity of a perfect black body was 1, the emissivity of the above blackened film was 0.6 at room temperature (25° C.).

Figure 7:
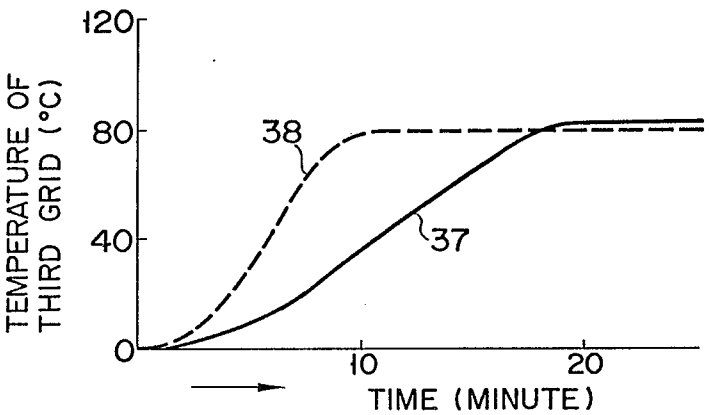
FIG. 7 is a graph showing a relationship between heating time and a temperature of a third grid.

FIG. 7 shows the periods of time required for attaining a stable temperature (about 80° C.) when member 33*a* of the third grid on the second grid side was blackened in the above-described manner. It was found that the time required for attaining the stable temperature is shortened by about 10 minutes when the blackened third grid (curve 38) was used as compared with a grid which were not blacked (curve 37).

Figure 5:
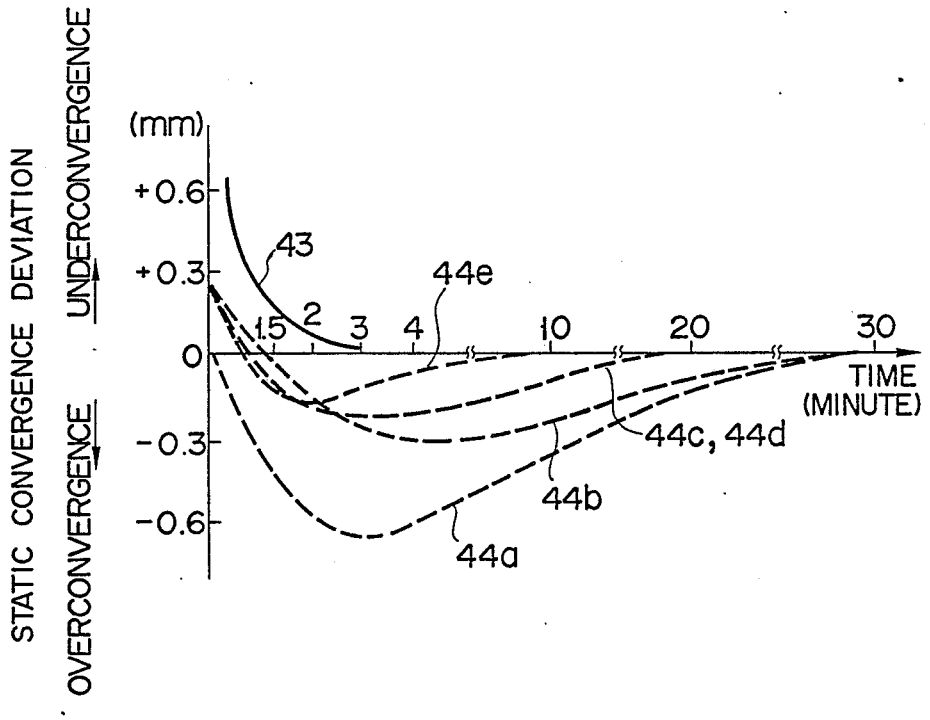
FIG. 5 is a graph showing changes in static convergence in CRT's of the present invention and of a comparative example.
Figure 6:
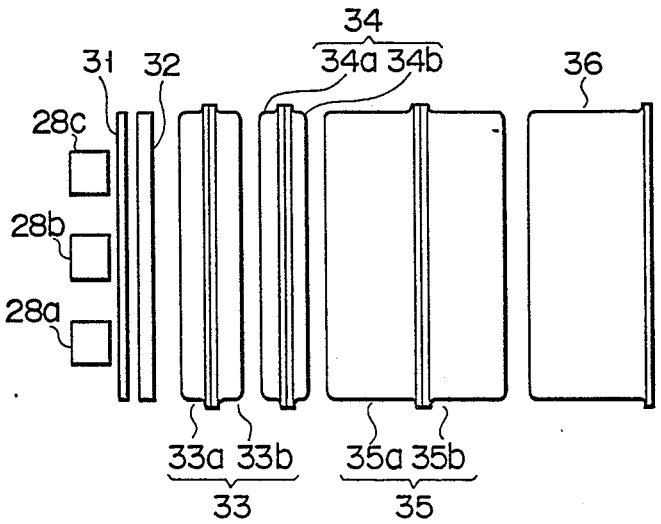
FIG. 6 is a side view of a color CRT electron gun according to one embodiment of the present invention.

Curves 44*c* and 44*d* shown in FIG. 5 respectively represent changes in static convergence with the lapse of time when only second grid side member 33*a* of the third grid is composed of a blackened-film member, and when only fourth grid side member 35*a* of the fifth grid is composed of a blackened-film member. In addition, curve 44*e* shows changes in static convergence with the lapse of time when second grid side member 33*a* of the third grid and fourth grid side member 35*a* of the fifth grid are composed of blackened-film members. In either case, the static convergence is greatly improved compared with curves 43, 44*a*, and 44*b* shown in FIG. 5. Especially, curve 44*e* shows ideal static convergence.

In a color CRT, especially in a display tube, it is preferable that no deviation is present in static convergence as a function of time, e.g., after 5 minutes, however, in practice, ±0.2 mm can be allowed. In curve 44*b*, in FIG. 5, a deviation in static convergence as a function of time, e.g., after 5 minutes was −0.3 mm, falling outside the allowable limit. However, in curves 44*c* and 44*d*, the maximum value in changes in static convergence after 2 minutes was −0.15 mm. In curve 44*e*, the maximum value in changes in static convergence after 1.5 minutes was −0.1 mm. Both fall within the allowable limit.

Figure 8:
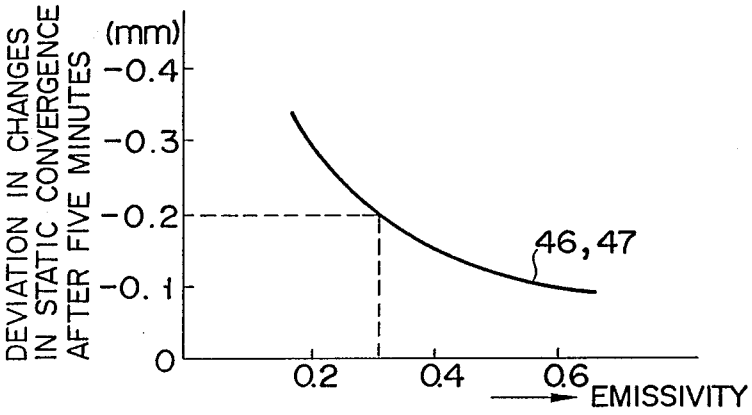
FIG. 8 is a graph showing emissivity and deviations in static convergence.

FIG. 8 shows the relationship between the emissivity when the emissivity of a perfect black body is 1 and the deviation in static convergence after 5 minutes in a case wherein second grid side member 33*a* of the third grid or forth grid side member 35*a* of the fifth grid are blackened. If both the emissivities when member 33*a* is blackened (curve 46) and when member 35*a* is blackened (curve 47) are 0.3 or more, the deviations in static convergence after 5 minutes fall within the allowable limit, i.e., −0.2 mm or less.

Figure 9:
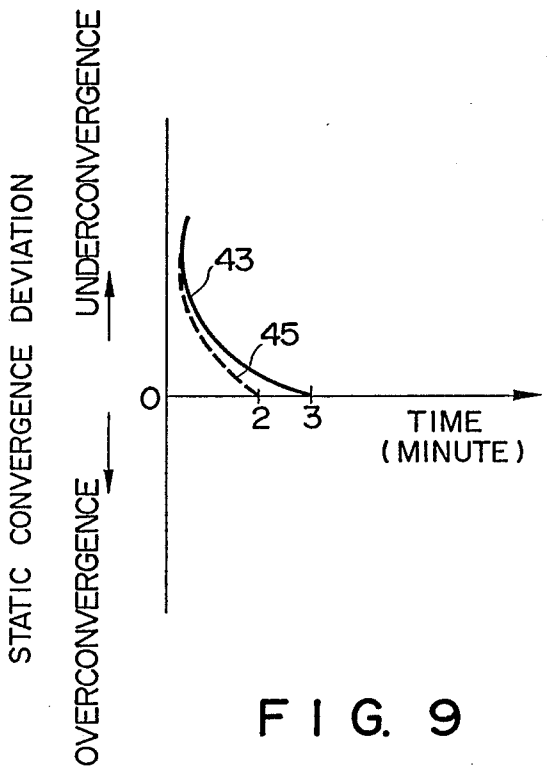
FIG. 9 is a graph showing changes in static convergence in CRT's of the present invention and a comparative example.

In the above example, the color CRT electron gun is described, in which each of the first and second grids is composed of a material having a low thermal expansion coefficient, and the grids from the third grid are composed of stainless steel. The present invention is not limited to these materials. More specifically, in grid structures of any materials, if an underconvergence component is excessively large in changes in static convergence with the lapse of time as a whole, a grid member for providing decelerating function to electron beams may be blacked, and if an overconvergence component is excessively large, a grid member for providing accelerating function to the electron beams may be blackened. For example, if the first to sixth grids are made of stainless steel except that a third grid side member of the fourth grid is composed of a blackened-film member, changes in static convergence with the lapse of time can be represented by curve 45 in FIG. 9. When a blackened-film member is not used, the time required for curve 43 representing that changes in static convergence with the lapse of time become 0 is 3 minutes, whereas the time required for curve 45 is shortened to about 2 minutes. In this case, a blackened-film member having an emissivity of 0.3 is used.

A method of forming a blackened film on a grid member is not limited to the method described in the above Example. In addition, the present invention is not limited to the case wherein a blackened-film member is formed on a grid, but the grid member itself may be blackened.

What is claimed is:

1. An in-line type color CRT electron gun comprising a triode and a plurality of grids, wherein at least one of said plurality of grids is composed of a black member or a member on which a black film is formed and wherein an emissivity of said black member or black film is 0.3 or more when an emissivity of a perfect black body is 1.

2. An electron gun according to claim 1, wherein each of said plurality of grids is formed of a pair of members combined with each other.

3. An electron gun according to claim 2, wherein said black film is formed on one member of said pair of members.

4. An electron gun according to claim 3, wherein an underconvergence component of static convergence in CRT is large, and a grid comprising said one member and another grid comprising another member facing said one member apply a decelerating function to electron beams.

5. An electron gun according to claim 4, wherein said black film is formed on another member.

6. An electron gun according to claim 3, wherein an overconvergence component of static convergence in CRT is large, and a grid comprising said one member and another grid comprising another member facing said one member apply an accelerating function to the electron beams.

7. An electron gun according to claim 6, wherein said black film is formed on another member.

8. An in-line type color CRT using an electron gun comprising a triode and a plurality of grids, wherein at least one of said plurality of grids is composed of a black member or a member on which a black film is formed, and wherein an emissivity of said black member or black film is 0.3 or more when an emissivity of a perfect black body is 1.

* * * * *